US005957742A

United States Patent [19]

Brennan et al.

[11] Patent Number: 5,957,742

[45] Date of Patent: Sep. 28, 1999

[54] SURFBOARD SIDE FIN

[76] Inventors: Joseph A. Brennan, 271 Graeser Ave., Bethel Park, Pa. 15102; Jerry N. Selness, 4611 Monongahela St., San Diego, Calif. 92117

[21] Appl. No.: 09/073,624

[22] Filed: May 6, 1998

Related U.S. Application Data

[60] Provisional application No. 60/045,734, May 6, 1997.

[51] Int. Cl.[6] ..... B63B 1/00

[52] U.S. Cl. ..... 441/79; 441/74

[58] Field of Search ..... 441/79, 74

[56] References Cited

U.S. PATENT DOCUMENTS

| | | | |
|---|---|---|---|
| 3,090,978 | 5/1963 | Hanson . | |
| 3,319,276 | 5/1967 | Penney | 441/79 |
| 3,323,154 | 6/1967 | Lambach . | |
| 4,296,511 | 10/1981 | Wright . | |
| 4,752,262 | 6/1988 | Martinmaas | 441/79 |
| 4,857,025 | 8/1989 | Brown et al. | 441/65 |

FOREIGN PATENT DOCUMENTS

| | | | |
|---|---|---|---|
| 2516472 | 5/1983 | France | 441/79 |

*Primary Examiner*—Jesus D. Sotelo

*Attorney, Agent, or Firm*—Webb Ziesenheim Logsdon Orkin & Hanson, P.C.

[57] ABSTRACT

A stabilizing, turning and controlling side fin for a surfboard or the like increases the performance and maneuverability of the surfboard or the like. The side fin may be provided on the right, left or both sides of the surfboard near the rear or middle portions of the surfboard. The side fin includes a deck portion forming a foot support and a roll over edge at the side thereof. The side fin is selectively submergible and provides a lift and thrust feel to the board when going through the water. In operation, when stepping on the deck portion of the side fin, or otherwise submerging a selected side fin, the board will turn in that direction. Stepping on the deck surface lightly will produce gradual turn and stepping on the deck surface heavily will produce a sharper turn. The side fin allows the board to essentially climb up on to the wave, giving the user the ability to maneuver and ride even small waves.

17 Claims, 8 Drawing Sheets

SURFBOARD SIDE FIN

This application claims the benefit of U.S. Provisional Patent Application Ser. No. 60/045,734 entitled "Surfboard Side Fin" and filed on May 6, 1997 and which is incorporated herein by reference.

BACKGROUND OF THE INVENTION

1. Field of the Invention

The present invention relates to quick and controlled turning with stabilizing fins on personal watercraft and to roll stability for personal watercraft. More particularly, the present invention relates to a stabilizing turning and control-enhancing side fin for a surfboard or the like to increase the performance and maneuverability of the surfboard or the like.

2. Background Information

The stability of small watercraft has been addressed in a variety of prior art devices. For example, U.S. Pat. No. 4,752,262 provides a pair of adjustable wings extending oppositely off of the deck surface of a sailboard. The proposed wings of the '262 patent are substantial structures, extending approximately 44 inches from the wing pivot axis to the wing tip. U.S. Pat. No. 3,090,978 discloses the use of a pair of retractable wings on the rear of water skis for improving the performance of the water skis at low speeds. U.S. Pat. No. 4,296,511 discloses a water ski having a chamber attached thereto which has the configuration of a venturi tube. The construction of the chamber is intended to lock the chamber and the associated structure in the water to enhance the stability and operating characteristics of the water ski.

The above-described prior art devices are not easily or meaningfully adapted for use in a surfboard environment. These prior art designs do not address the particular problems associated with a surfboarding environment. They do not provide the user control which is necessary in surfboarding.

It is an object of the present invention to overcome the aforementioned drawbacks of the prior art. It is a further object of the present invention to provide a side fin for a surfboard or the like which increases the stability of the surfboard, and provides a more controlled and quicker maneuverability for the surfboard. It is another object of the present invention to provide a side fin for a surfboard which selectively modifies the lift and drag and thrust distribution while surfboarding. It is another object of the present invention to provide a surfboard side fin which is easily manufactured and easy to utilize.

SUMMARY OF THE INVENTION

The above objects are achieved by providing a selectively submergible side fin for personal watercraft, particularly a surfboard, according to the present invention. The side fin of the present invention may be provided on the right or left side, or both sides of the surfboard near the rear portion of the board, but it may also be used preferably near the middle and forward portion for example for "nose riding". The side fin of the present invention may be detachably mounted to the surfboard or, alternatively, may be permanently attached to the surfboard.

A side fin of the present invention includes a deck portion extending from a portion of the upper surface of the surfboard but preferably shaped with a lifting surface that is activated in a turn. The side fin of the present invention additionally includes a rollover edge at a side thereof extending substantially parallel to the body of the surfboard. The roll over edge enhances the full range of performance for the side fin and enhances quick rail performance for a surfboard with the side fin attached.

The side fin is specifically configured to provide a lift and thrust feel to the board when going through the water. In operation, when stepping on the deck portion of the side fin, the side fin is submerged and the board will turn in that direction. Stepping on the deck surface lightly will produce a gradual turn and stepping on the deck surface heavily produces a sharper turn in that direction. Normally, the surfboard will turn in the direction of the submerged side fin, however, it may be possible for a surfer to have the board turn in a direction opposite the submerged side fin, but this operation would be an exception. The side fin may be submerged by a method other than stepping on the side fin, such as shifting the user's weight toward the selected side fin. As discussed above, the side fin produces both a lift, drag, and moreover a thrust feel to the board. The lift and drag allow the board essentially to climb up on the wave. The lift gives the board the ability to maneuver and to ride even small waves.

These and other advantages of the present invention will be clarified in the description of the preferred embodiments taken together with the attached figures wherein like reference numerals represent like elements throughout.

BRIEF DESCRIPTION OF THE PREFERRED EMBODIMENTS

Figures 1, 2:
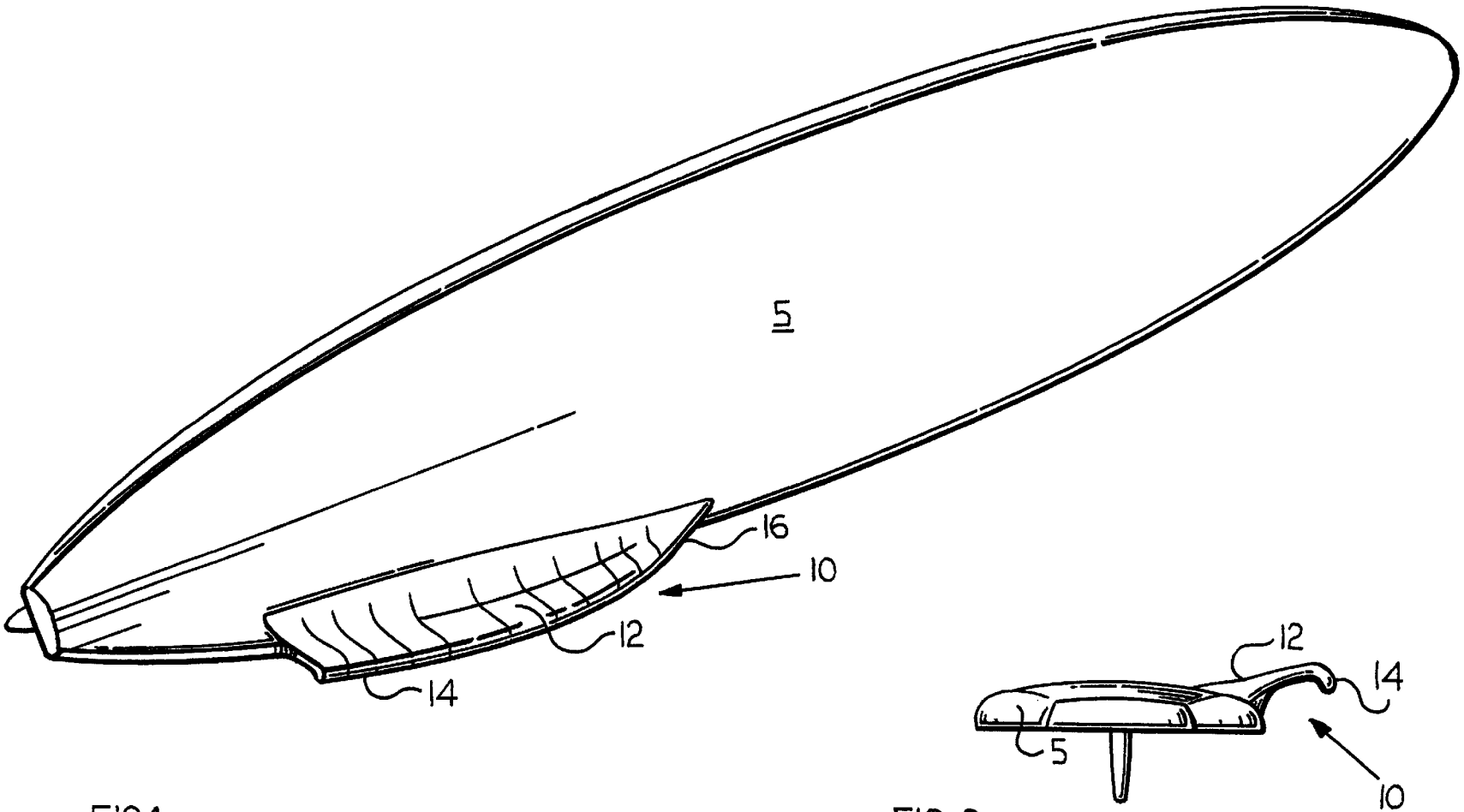
FIG. 1 is a top perspective view of a surfboard and side fin according to a first embodiment of the present invention.
FIG. 2 is a rear elevational view of the surfboard and side fin illustrated in FIG. 1.
Figure 3:
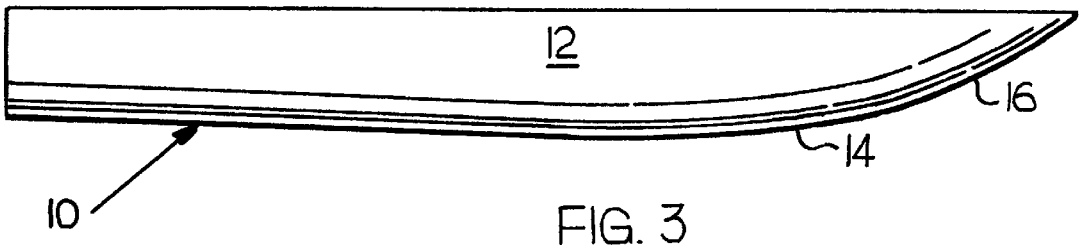
FIG. 3 is a top view of the side fin illustrated in FIGS. 1–2.
Figure 9:
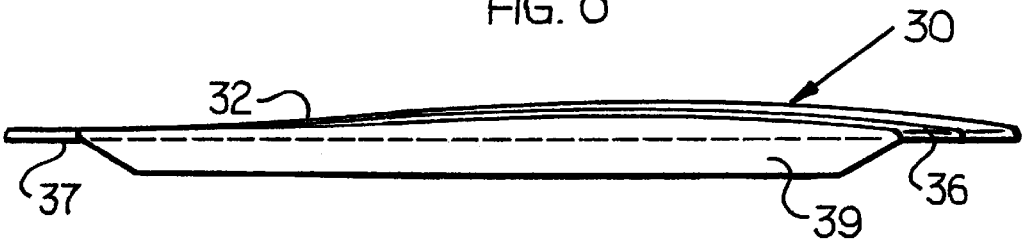
FIG. 9 is a side view of the side fin illustrated in FIG. 8.
Figure 11:
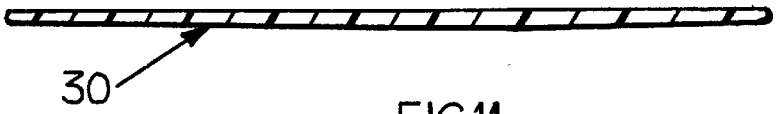
Figure 12:
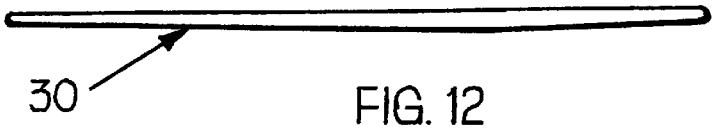
Figure 10B:
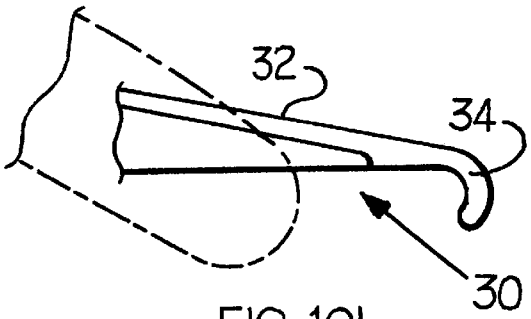
Figure 10A:
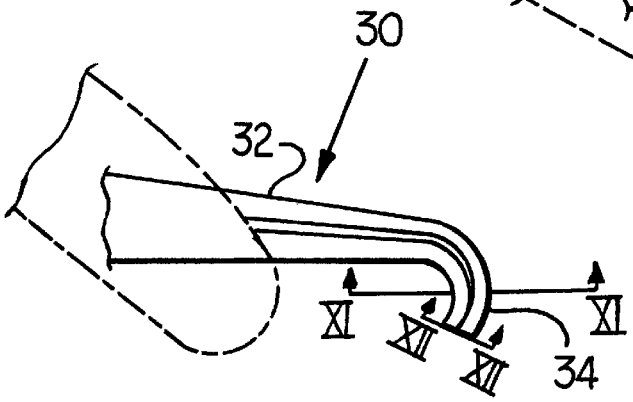
Figure 13:
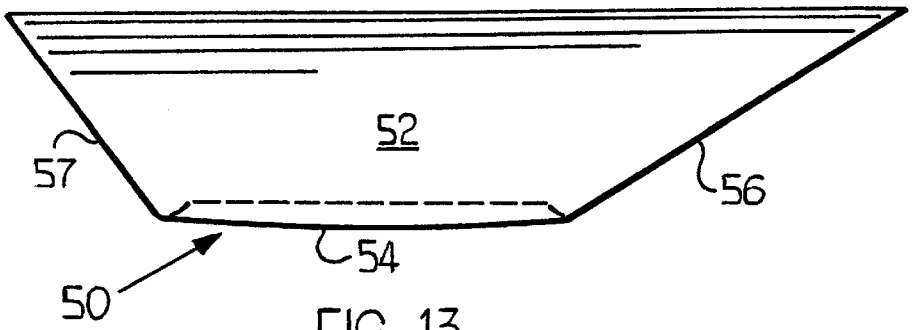
Figure 14:
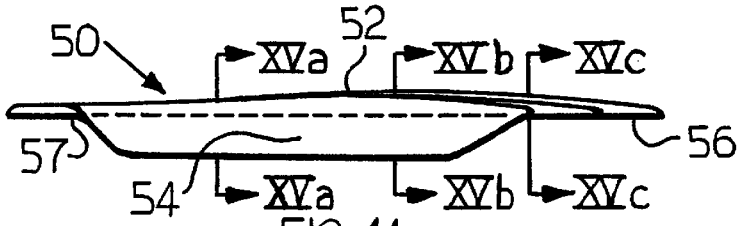
Figure 16:
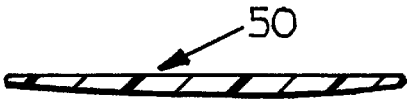
Figure 17:
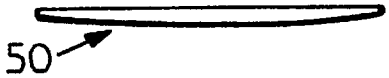
Figure 15A:
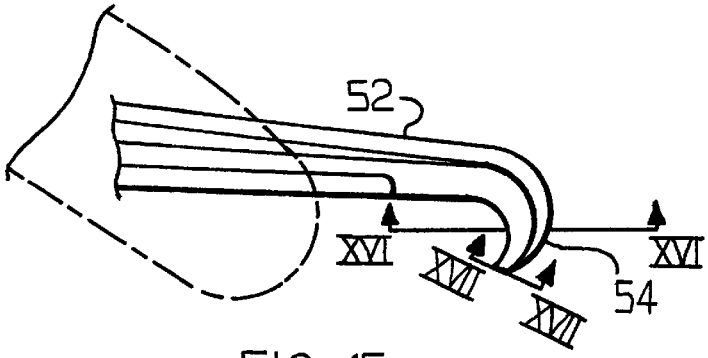
Figure 15B:
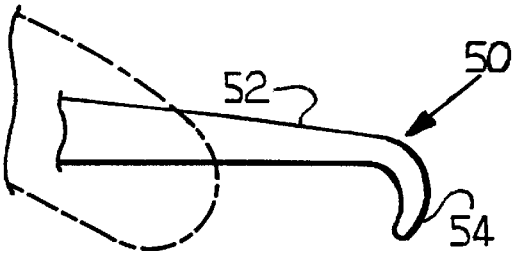
Figure 15C:
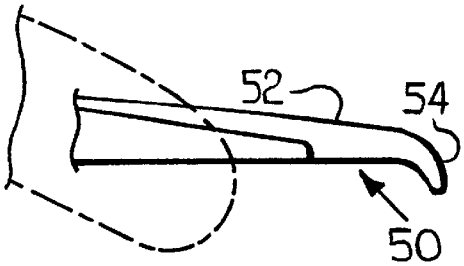
Figure 18:
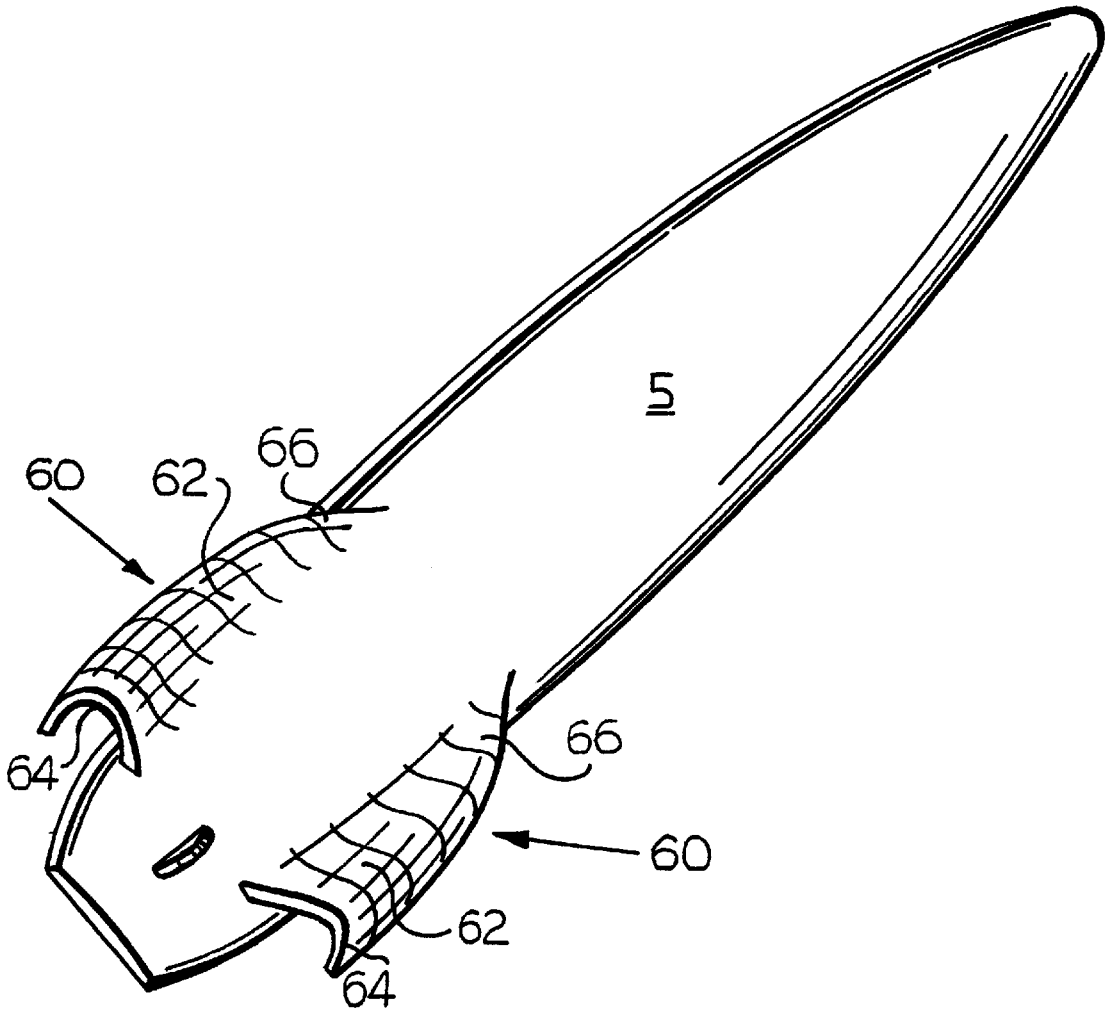
Figure 19:
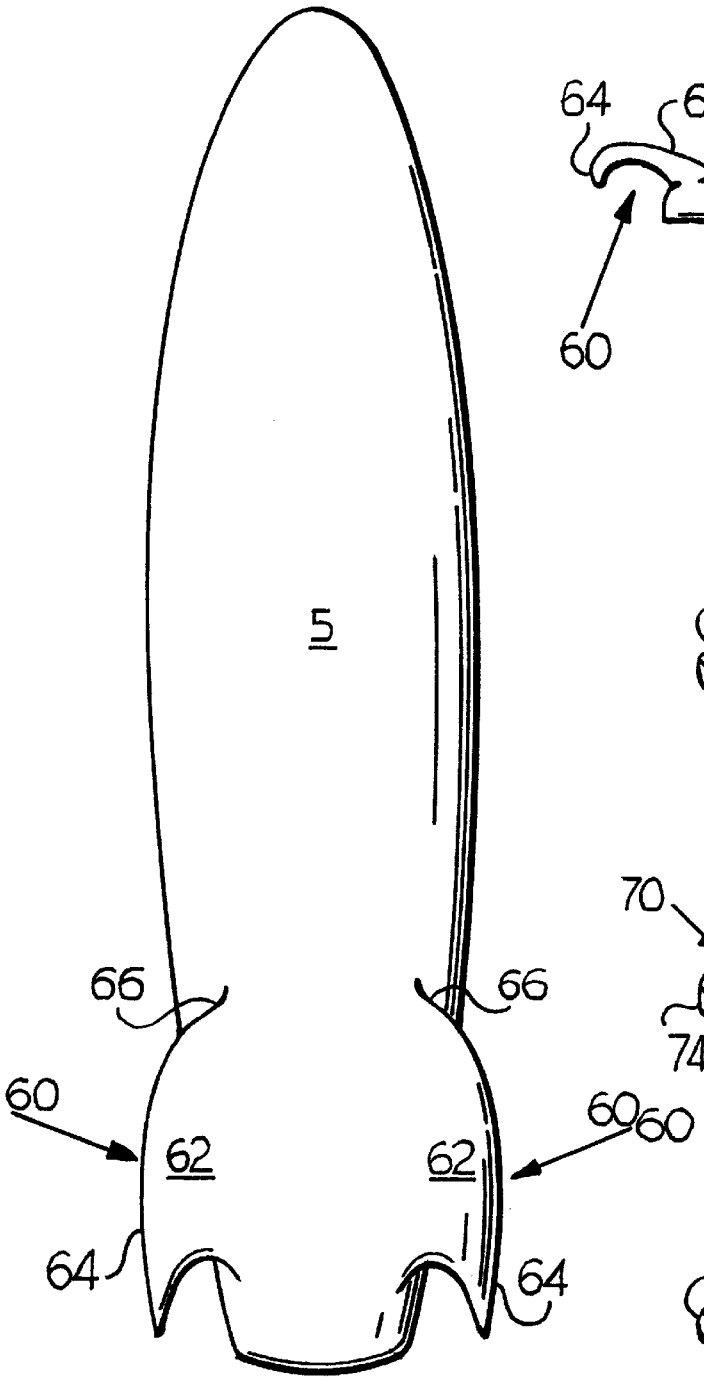
Figure 20:
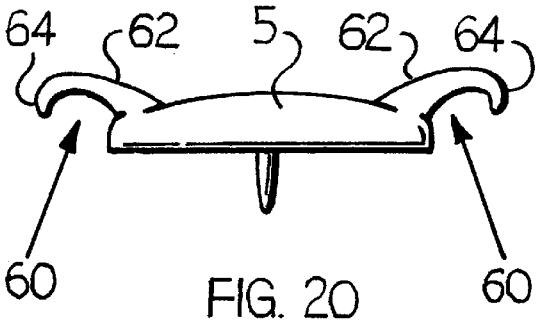
Figure 23A:
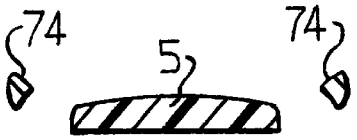
Figure 23B:
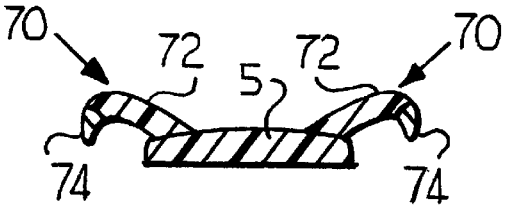
Figure 23C:
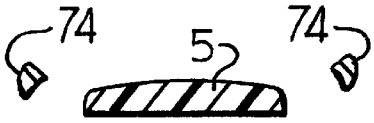
Figure 21:
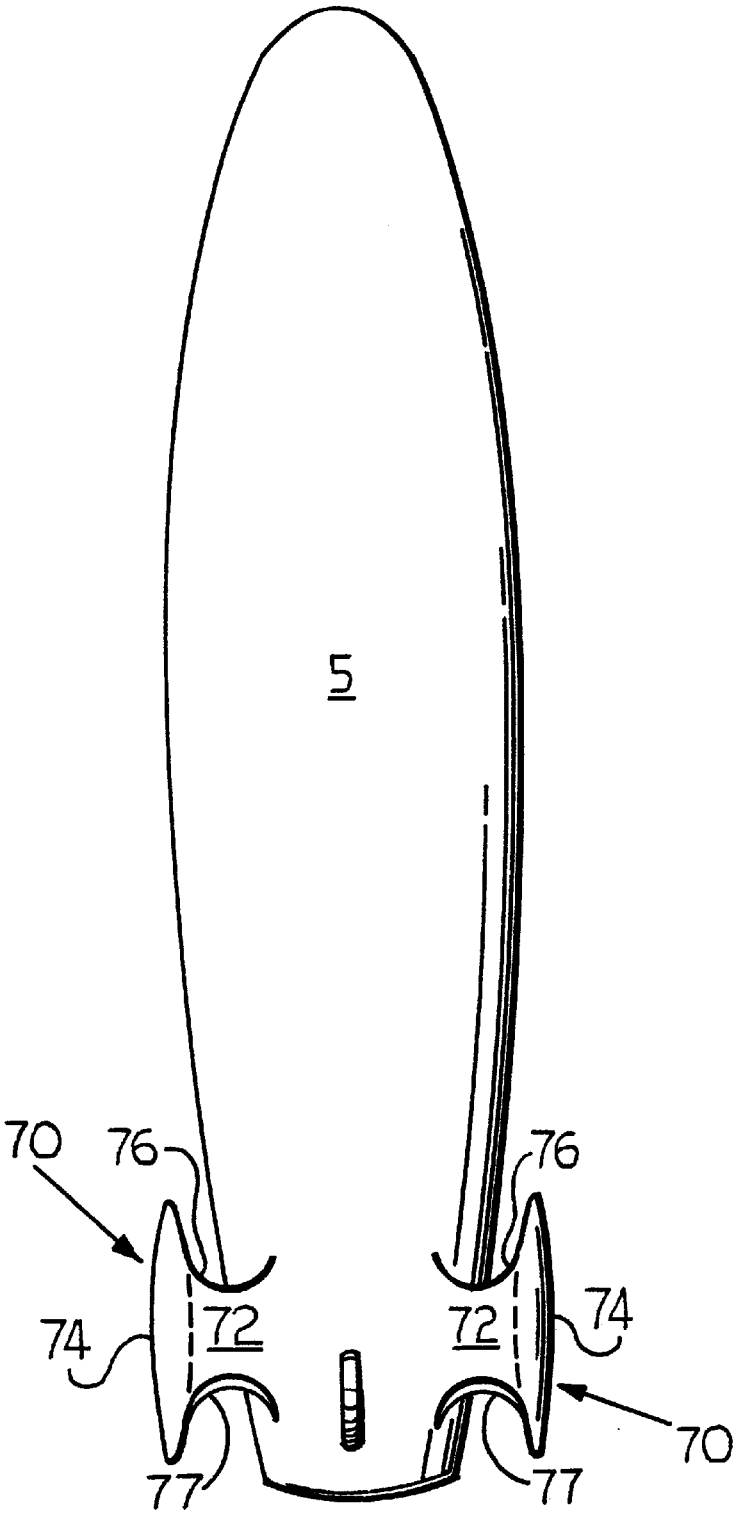
Figure 22:
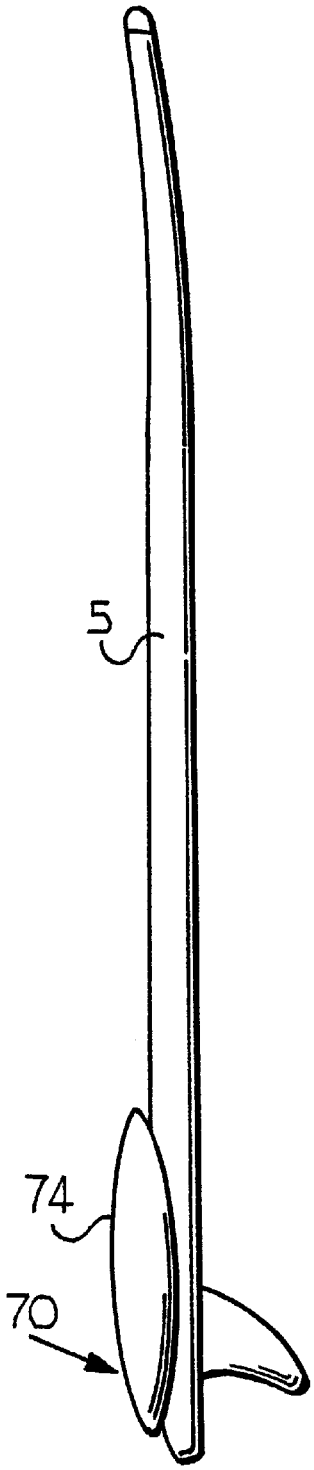
Figure 24:
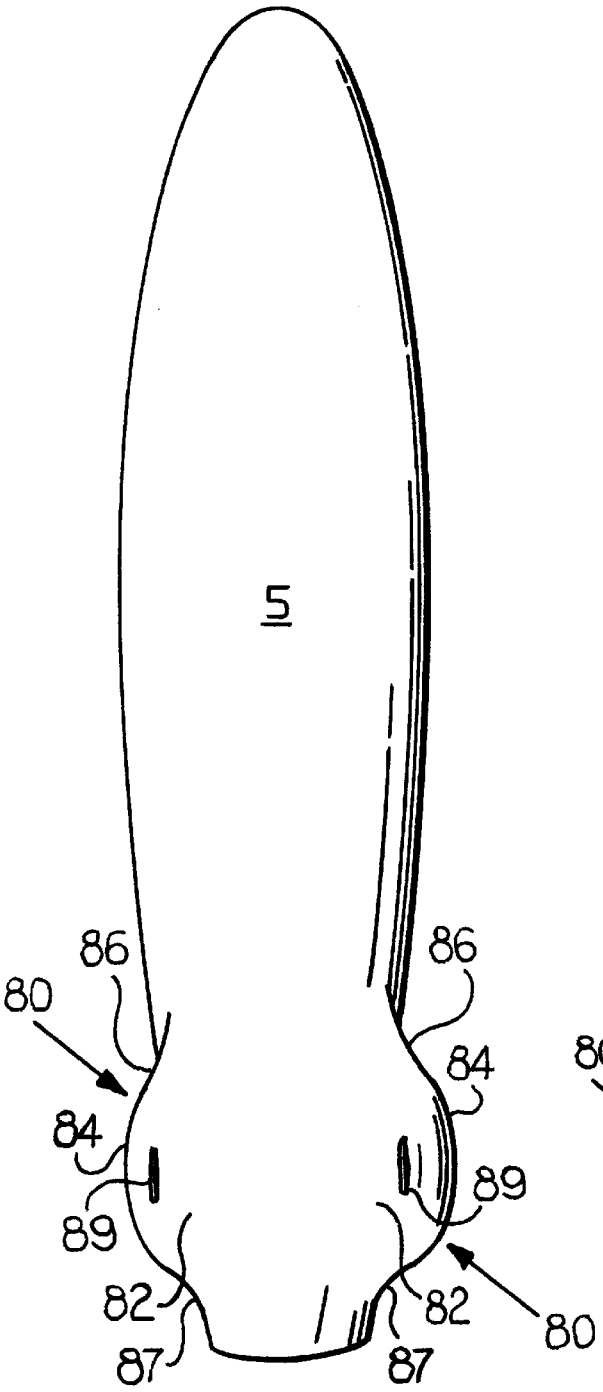
Figure 25:
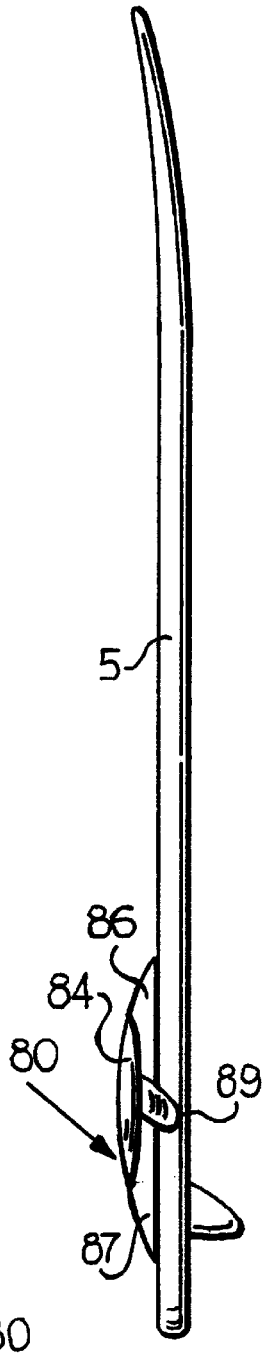
Figure 26:
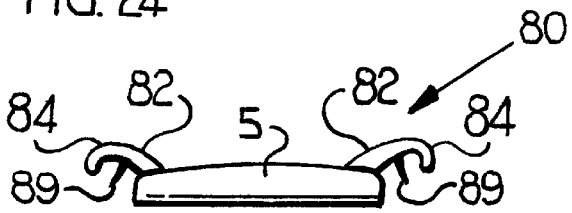

FIGS. 10*a* and 10*b* are cross-sectional views of the side fin illustrated in FIG. 9;

FIG. 11 is a longitudinal section view along a roll over midpoint of the side fin illustrated in FIGS. 10*a*–10*b*;

FIG. 12 is an end view along a bottom edge of the roll over of the side fin illustrated in FIGS. 10*a*–10*b*;

FIG. 13 is a top view of a side fin according to a third embodiment of the present invention;

FIG. 14 is a side view of the side fin illustrated in FIG. 13;

FIGS. 15*a*, 15*b* and 15*c* are cross-sectional views of the side fin illustrated in FIG. 13;

FIG. 16 is a longitudinal sectional view along a roll over midpoint of the side fin illustrated in FIGS. 15*a–c*;

FIG. 17 is an end view along a bottom edge of the roll over of the side fin illustrated in FIGS. 15*a–c*; and FIG. 18 is a top perspective view of a surfboard and side fins according to a fourth embodiment of the present invention;

FIG. 19 is a top view of the surfboard and side fin illustrated in FIG. 18;

FIG. 20 is a rear elevational view of the surfboard and side fins illustrated in FIG. 18;

FIG. 21 is a top view of a surfboard and side fins according to a fifth embodiment of the present invention;

FIG. 22 is a side view of the surfboard and side fins illustrated in FIG. 1;

FIGS. 23A–23C are sectional views of the surfboard and side fins illustrated in FIG. 21;

FIG. 24 is a top view of a surfboard and side fins according to a sixth embodiment of the present invention;

FIG. 25 is a side view of the surfboard and side fins illustrated in FIG. 24; and FIG. 26 is a rear elevational view of the surfboard and side fins illustrated in FIG. 24.

DESCRIPTION OF THE PREFERRED EMBODIMENTS

FIG. 1 illustrates a top perspective view of a surfboard 5 with a selectively submergible side fin 10 according to a first embodiment of the present invention. The FIGS. 1–7 illustrate a right side fin 10 for the surfboard 5 or the like. A left side fin may be formed as a mirror image of the right side fin 10 shown in the figures. The surfboard 5 according to the present invention may include either a right side fin 10 as shown in FIGS. 1–2, a left side fin or both. The side fin 10 extends laterally of the body of the surfboard 5 as shown in FIGS. 1–2.

The side fin 10 includes a deck portion 12 extending substantially parallel and adjacent to the upper surface of the surfboard 5. The deck portion 12 provides a foot support for the user as will be described. The side fin 10 additionally includes a rollover edge 14 adjacent the deck portion 12. The rollover edge 14 is most clearly illustrated in FIG. 5 and turns at least 90° with respect to the deck portion 12. The forward edge 16 of the front of the deck portion 12 is tapered away from the attached surfboard 5 as shown in FIG. 1 and forms a leading edge of a wing-type structure as will be described. The tapering of the forward edge 16 also allows the user's legs to more easily slide past the extension of the surfboard 5 provided by the side fin 10.

Figure 4:
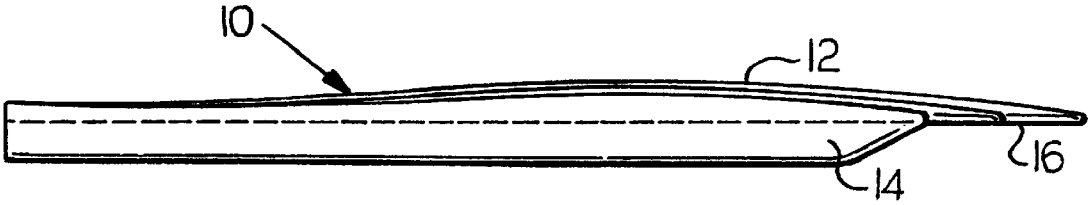
FIG. 4 is a side view of the side fin illustrated in FIG. 1.
Figure 6:
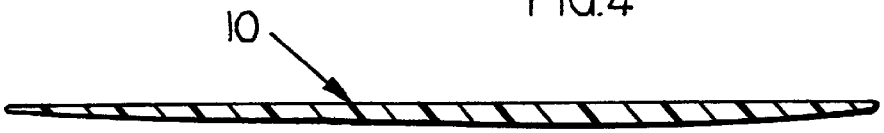
FIG. 6 is a longitudinal section view along a roll over edge mid-point of the side fin illustrated in FIG. 5.
Figure 7:
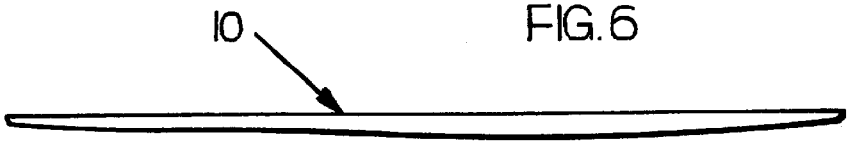
FIG. 7 is an end view along a bottom edge of the roll over edge of the side fin illustrated in FIG. 5.
Figure 5:
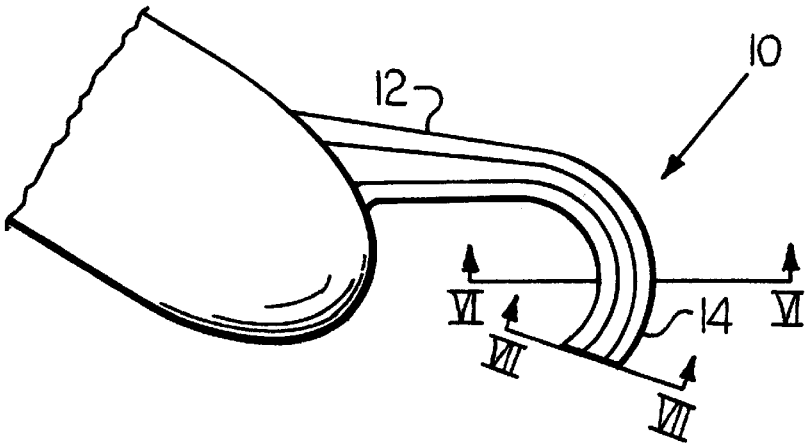
FIG. 5 is a cross-sectional view of the side fin illustrated in FIG. 4.

The side fin 10 forms a wing member and is specifically designed to provide a lift, drag and thrust feel to the surfboard when the side fin 10 is pushed through or on the water. The specific contouring of the side fin 10 can be shown by separate contouring lines in FIG. 4 representing specific contours of the side fin 10 along spaced sections. FIGS. 6 and 7 illustrate the longitudinal cross-sectional configuration of the roll over edge 14 taken along a midpoint of the roll over edge 14 and a bottom edge of the roll over edge 14, respectively, shown in FIG. 3. The side fin 10 of the present invention can be formed in an economical fashion as a laminate skin formed over a foam core. For example, the laminate skin may be formed of two layers of six-ounce E glass cloth, combined with a polymer resin matrix material.

The side fin 10 of the present invention is preferably permanently attached to the surfboard 5. Specifically, the inside side fin edge flares into the rail of the surfboard 5. A laminate layer forms a C-cup that is compatible with the surfboard 5 and is laminated to the surfboard top and bottom to permanently attach the side fin 10 thereto. However, if desired, alternative construction can be performed to make the side fin 10 removable through various attachment mechanisms such as are known in the art.

In operation, the user of the surfboard 5 with a right side fin 10 (and/or a left side fin) according to the present invention operates as follows. When standing on the surfboard 5 after catching a wave and the user desires to turn to the right, the user steps on the deck portion 12 of the side fin 10 on the right side of the surfboard 5 to selectively submerge the side fin 10. By stepping lightly, the surfboard 5 will turn gently to the right. Stepping more heavily will result in a significantly sharper turn. The side fin 10 may be selectively submerged by other than stepping directly on the deck portion 12, such as shifting the user's weight toward the side fin 10. The side fins 10 of the present invention, as discussed above, are specifically designed to provide a lift, drag and also a thrust feel to the surfboard 5 based upon the specific profile. This configuration will allow the user to quickly climb the wave in a timely fashion. The roll over edge 14 with built in lift will allow the user to ride relatively small waves. The side fin 10 of the present invention increases the stability and maneuverability of the surfboard 5.

With regard to specific dimensions, the side fin 10 is approximately 24 inches long with the deck portion 12 being about two inches wide and the rollover edge 14 being at least approximately an inch or so in depth. However, it will be apparent to those of ordinary skill in the art that these dimensions can be easily altered within a significant range and still be within the scope of the present invention as exemplified in the embodiments discussed below.

Figure 8:
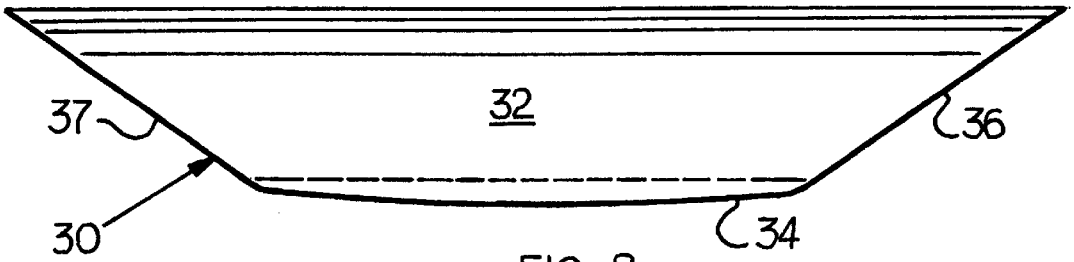
FIG. 8 is a top view of a side fin according to a second embodiment of the present invention.

FIGS. 8–12 illustrate a side fin 30 according to a second embodiment of the present invention. The side fin 30 illustrated in FIGS. 8–12 is a right side fin 30 for a long board (not shown) of approximately 9.6 inches long. A left side fin for the long board can be formed as a mirror image of the right side fin 30. The side fin 30 is substantially similar to the side fin 10 illustrated in FIGS. 1–7. The side fin 30 includes a deck portion 32 extending substantially parallel and adjacent to the upper surface of the long board. The side fin 30 additionally includes a roll over edge 34 adjacent the deck portion 32. The roll over edge 34 is most clearly illustrated in sectional views 10*a* and 10*b*. The side fin 30 additionally includes a upper forward edge 36 on the front of the deck portion 32 similar to the forward edge 16 of side fin 10. Side fin 30 most noticeably differs from side fin 10 by including a tapered rear edge 17 along the back of the deck portion 32 as shown in FIG. 8. The selectively submergible side fin 30 operates substantially the same manner as side fin 10 discussed above. The side fin 30 may be formed essentially the same manner as side fin 10 discussed above and attached to the surfboard in substantially the same manner. It is also anticipated the laminated skin of side fin 30 may further include an outside layer of 4 ounce CSM over the two layers of 6 ounce E-glass cloth. The side fin 30 merely intends to illustrate a different embodiment within the scope of the present invention. The specific dimensions of side fin 30 differ from side fin 10 in that the side fin 30 is specifically designed for a long board. The side fin 30 is approximately 28 inches long with the deck portion 32 being about two inches wide and the roll over edge 34 being at least approximately an inch or so in depth.

FIGS. 13–17 illustrate a side fin 50 according to a third embodiment of the present invention. The side fin 50 is a right side fin specifically designed for a short board(not shown)of approximately 6 foot 2 inches long. A left side fin for a short board to be formed as mirror image of the right side fin 50 illustrated in FIGS. 13–17. The side fin 50 is substantially the same as side fin 10 and 30 discussed above and includes a deck portion 52, roll over edge 54, forward edge 56, and rearward edge 57. The operation, construction and attachment of the selectively submergible side fin 50 to the short board is substantially the same as discussed above in connection with side fins 10 and 30. Side fins 30 and 50 have been added to illustrate specific modifications of the present invention associated with various dimensions of boards. The side fin 50 has dimensions different from the side fins 10 and 30 discussed above and includes the length of approximately 16–17 inches. The deck portion 52 is about two inches wide and the roll over edge 54 is at least approximately an inch or so in depth. As with side fins 10 and 30 discussed above it will be apparent to those skilled in the art that the specific dimensions illustrated in the figures for the side fin 50 can be easily altered within a significant range to provide an operational side fin within the scope of the present invention.

FIGS. 18–20 illustrate a surfboard 5 with a pair of side fins 60 according to a fourth embodiment of the present invention. The side fins 60 can be attached to or made integral with a surfboard 5 as illustrated. Each side fin 60 is essentially the same as side fins 10, 30 and 50 discussed above. Each side fin 60 includes a deck portion 62, a roll over edge 64 and a forward edge 66. The operation, construction and attachment of the submergible side fins 60 to the surfboard 5 is essentially the same as discussed above in connection with the side fins 10, 30 and 50. The deck portion 62 of each side fin 60 is illustrated as extending at a slightly greater angle relative to the top surface of the surfboard 5 than the deck portions 12, 32 and 52 of the previous side fins 10, 30 and 50. The side fin 60 is shown to illustrate the various shapes and configurations within the scope of the present invention.

FIGS. 21, 22 and 23A–C illustrate a surfboard 5 with a pair of side fins 70 according to a fifth embodiment of the present invention. Each side fin 70 is similar to the side fins 10, 30, 50 and 60 described above and includes a deck portion 72, a roll over edge 74, a forward edge 76 and a rearward edge 77. The operation, construction and attachment of each selectively submergible side fin 70 to the surfboard 5 is essentially the same as discussed above in connection with the previous side fins 10, 30, 50 and 60. The side fin 70 most significantly differs from the previous side fins 10, 30, 50 and 60 by the provision of a concavely curved forward edge 76 and rearward edge 77 which serves to minimize the deck portion 72 as best illustrated in FIG. 21. This construction is believed to highlight or increase the relative effect during operation of the roll over edge 74. Specifically, the inner surface of the roll over edge 74 is believed to be a key element in this specific design as a turning surface. The side fin 70 is primarily illustrated to demonstrate the wide variations possible with side fins according to the present invention.

FIGS. 24, 25 and 26 illustrate a surfboard with a pair of side fins 80 according to a sixth embodiment of the present invention. Each side fin 80 is substantially the same as the side fins 10, 30, 50 and 70 described above and includes a deck portion 82, roll over edge 84, a forward edge 86 and a rearward edge 87. As illustrated in FIGS. 25 and 26, the side fin 80 most significantly differs from the previous side fins by the inclusion of a downwardly extending vertical fin 89. As will be apparent to those of ordinary skill in the art when the selectively submergible side fin 80 is placed in the water the vertical or stabilizing fin 89 will also be submerged and will effect the operational characteristics of the surfboard 5 with side fin 80. The side fin 80 is primarily illustrated to demonstrate some of the many variations possible within the scope of the present invention.

Various changes may be made to the present invention without departing from the spirit or scope thereof. For example, while the present invention is particularly suited for surfboarding, it may have other applications such as sailboards or body boards also referred to as Boogie boards. The examples discussed above are merely illustrative of the present invention and not restrictive thereof. The scope of the present invention is defined by the appended claims and equivalents thereto.

What is claimed is:

1. A selectively submergible side fin for attachment to a side of a personal watercraft, said side fin comprising:

a deck portion adapted to extend from an upper surface of the watercraft;

a coupling side for attaching said side fin to said watercraft; and a roll over edge adjacent an outer end of said deck portion spaced from said coupling side, said roll over edge extending below a lower surface of said deck portion.

2. The side fin of claim 1 wherein said coupling side is adapted to attach said side fin to a surfboard.

3. The side fin of claim 1 wherein said deck portion provides at least a temporary foot support to the user for selectively submerging said side fin.

4. The side fin of claim 1 wherein said rollover edge has a depth of at least about one inch.

5. The side fin of claim 1 further including a vertically extending fin extending downwardly from said lower surface of said deck portion, said vertically extending fin positioned between said roll over edge and said coupling side.

6. The side fin of claim 1 wherein said coupling side is adapted to position said deck portion to extend at an angle from an upper surface of said watercraft.

7. A watercraft comprising:

a main body for supporting a user; and at least one selectively submergible side fin extending laterally beyond said main body, wherein said side fin is adapted to be selectively submergible, each said side fin including a deck portion extending from an upper surface of said main body and a roll over edge at an outer side of said deck portion wherein said roll over edge extends below a lower surface of said deck portion.

8. The watercraft of claim 7 wherein said deck portion forms a foot support for the user.

9. The watercraft of claim 7 wherein each said side fin further includes a vertically extending fin downwardly from a lower side of said deck portion.

10. The watercraft of claim 7 further including a pair of said side fins, one said side fin on each side of said watercraft.

11. A surfboard comprising:

a main body for supporting a user; and at least one selectively submergible side fin extending laterally beyond said main body, said side fin positioned on said main body such that the user can selectively submerge said side fin, wherein said side fin includes a deck portion extending from said main body and a roll over edge at an outer side of said deck portion spaced from said main body, said roll over edge extending below a lower surface of said deck portion.

12. The surfboard of claim 11 where said deck portion has a width of about two inches and said roll over edge has a depth of at least about one inch.

13. The surfboard of claim 11 wherein said deck portion extends from an upper surface of said surfboard.

14. The surfboard of claim 13 wherein said deck portion forms at least a temporary foot support for the user for selectively submerging said side fin.

15. The surfboard of claim 13 wherein each said side fin further includes a vertically extending fin extending downwardly from a lower side of said deck portion.

16. The surfboard of claim 13 wherein each said side fin is integral with said main body.

17. The surfboard of claim 13 wherein a pair of said side fins are provided, one said side fin on each side of said main body.

* * * * *